United States Patent [19]

Drabowitch

[11] 4,322,731

[45] Mar. 30, 1982

[54] DISK-TYPE ULTRA-HIGH FREQUENCY ANTENNA ARRAY WITH ITS SUPPLY DEVICE AND THE APPLICATION THEREOF TO ANGULAR DEVIATION MEASUREMENT RADARS

[75] Inventor: Serge Drabowitch, Paris, France

[73] Assignee: Thomson-CSF, Paris, France

[21] Appl. No.: 146,370

[22] Filed: May 2, 1980

[30] Foreign Application Priority Data

May 8, 1979 [FR] France ..... 79 11629

[51] Int. Cl.[3] ..... H01Q 1/36

[52] U.S. Cl. ..... 343/895; 343/771; 343/767

[58] Field of Search ..... 343/767, 770, 771, 895, 343/766, 777

[56] References Cited

U.S. PATENT DOCUMENTS

| | | | |
|---|---|---|---|
| 3,022,506 | 2/1962 | Goebels et al. | 343/771 |
| 3,063,049 | 11/1962 | Kelly | 343/771 |
| 3,524,151 | 8/1970 | Safran | 333/137 |
| 3,576,579 | 4/1971 | Appelbaum et al. | 343/778 |
| 3,731,235 | 5/1973 | Ditullio et al. | 343/777 |
| 3,745,585 | 7/1973 | Barbano | 343/895 |

OTHER PUBLICATIONS

IRE National Conventional Record, Part 1, No. 1, 157 IEEE Inc., New York, (US) K. C. Kelly: "Recent annular slot array experiments", pp. 144–152.

*Primary Examiner*—David K. Moore

*Attorney, Agent, or Firm*—Cushman, Darby & Cushman

[57] ABSTRACT

A disk-type antenna array is described with its supply device. The antenna is supplied with an electromagnetic wave having circular polarization in the $TE_{11}$ mode delivered through a particular coupling means.

7 Claims, 5 Drawing Figures

1
1
1
1
r
α
4
3

1
2
7
6
5
O
3
CYLINDRICAL CAVITY
MATCHED LOAD
6
1 ANTENNA
2
PHASE SHIFTER
5
MATCHED LOAD
E
TE11
4
CIRCULAR GUIDE
E
H

FIG. 2a
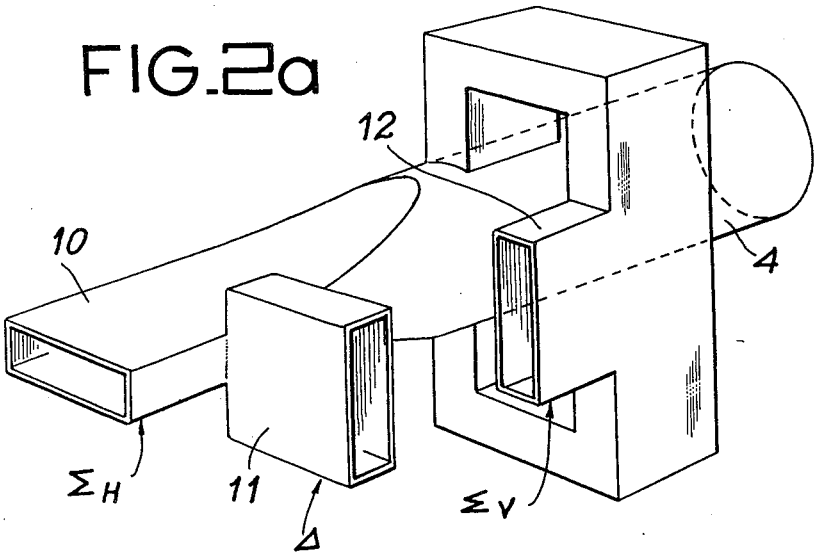
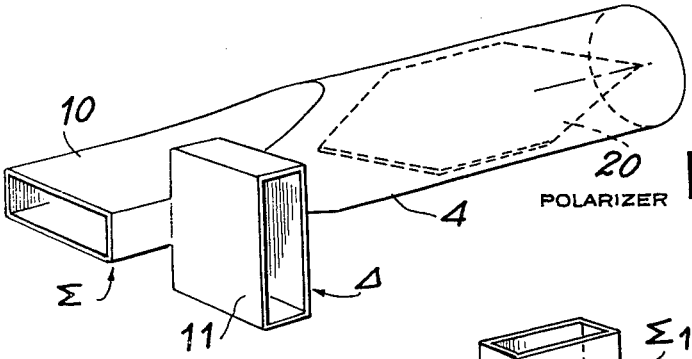
FIG. 2b
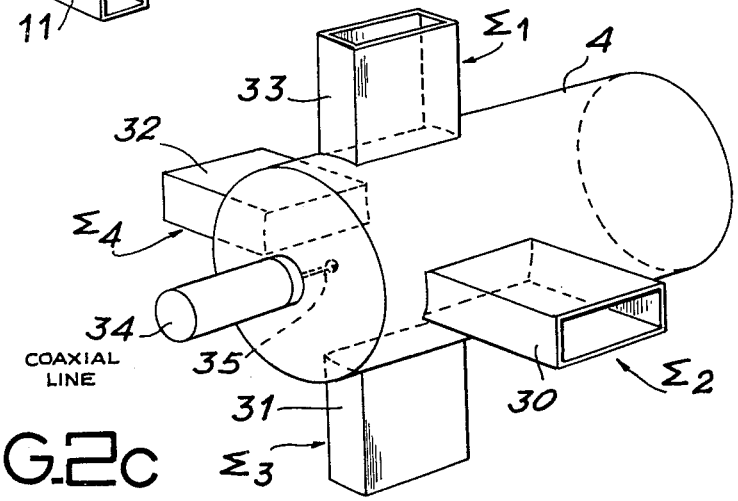
FIG. 2c

DISK-TYPE ULTRA-HIGH FREQUENCY ANTENNA ARRAY WITH ITS SUPPLY DEVICE AND THE APPLICATION THEREOF TO ANGULAR DEVIATION MEASUREMENT RADARS

BACKGROUND OF THE INVENTION

The present invention relates to disk-type ultra-high frequency antenna arrays, more particularly associated with radars carrying out measurements of angular deviation.

The disk-type antenna array is known. In its present form, such an antenna comprises a cylindrical cavity of large diameter and small thickness. One of the faces of this cavity is connected at its center to a circular section guide, the other face is provided with elementary antennae, spread out along concentric circles and coupled electromagnetically with the inside of the cavity. When transmitting, the circular guide is then fed with an electromagnetic wave in the $TM_{01}$ mode which generates in the cavity a circular radial wave.

The circular guide is connected to a T delivering on reception on at least two distinct channels the summing $\Sigma$ and difference $\Delta$ signals required for elaborating the angular deviation measurement signal $\epsilon$. For transmitting it is the summing channel of this T which receives the electromagnetic wave transmitted to the disk-type antenna array.

This type of embodiment presents several drawbacks due to the required use of a $TM_{01}$ mode wave; in fact, a wide frequency band and a high power level are difficult to obtain because of the requirement of energizing the antenna in the $TM_{01}$ mode. This latter is generally obtained by means of the difference channel of a magic T connected to the summing channel of the T of the antenna, this difference channel being difficult to match and having poor power behavior.

SUMMARY OF THE INVENTION

The device of the invention aims at remedying these drawbacks by feeding the circular guide connected to the antenna with an electromagnetic wave in the $TE_{11}$ mode which may then come directly from the ultra-high frequency oscillator.

The above and other objects, features and advantages of the present invention will become apparent from the following description, given solely by way of non-limiting illustration, when taken in conjunction with the accompanying drawings.

DESCRIPTION OF THE DRAWINGS

FIG. 2*a* shows a fork-type T of the prior art.

FIG. 2*b* shows a fork-type T in accordance with the invention.

FIG. 2*c* shows a coupler of the turnstile type.

DESCRIPTION OF THE PREFERRED EMBODIMENT

An electromagnetic wave in mode $TE_{11}$ with horizontal polarization generates in the cylindrical cavity of the disk-type antenna array at a point of polar coordinates (r, $\alpha$), a radial current field whose amplitude law is defined by a double circle diagram defined by the equation:

$$f_1(r,\alpha)=I(r)e^{-ikr}\cdot\cos\alpha$$

with $k=2\pi/\lambda$ where $\lambda$ is the wavelength of the electromagnetic wave used.

I(r) represents the attenuation of the current with respect to the radial distance.

The same mode $TE_{11}$ with phase quadrature and vertical polarization gives a second radial current whose amplitude law is given by the double circle diagram defined by the equation:

$$f_2(r,\alpha)=iI(r)e^{-ikr}\cdot\sin\alpha$$

The energization of the cavity of the antenna in fundamental mode $TE_{11}$ with circular polarization provides a current whose amplitude law (f) is obtained by adding the $f_1$ and $f_2$ laws, i.e. $f=f_1+f_2$, $$f(r,\alpha)=f_1+f_2=I(r)e^{-ikr}e^{i\alpha}$$

This is the equation for an omnidirectional rotating field whose wave surfaces are archimedes spirals having polar equation $\alpha-kr=u$, u being a constant number.

This radial field is collected by directional probes enabling the law of radial dependence s(r) to be chosen, generally Gaussian, supplying the elementary antennae through phase shifters counterbalancing the radial phase shift term $\phi=-kr$.

Figure 1B:
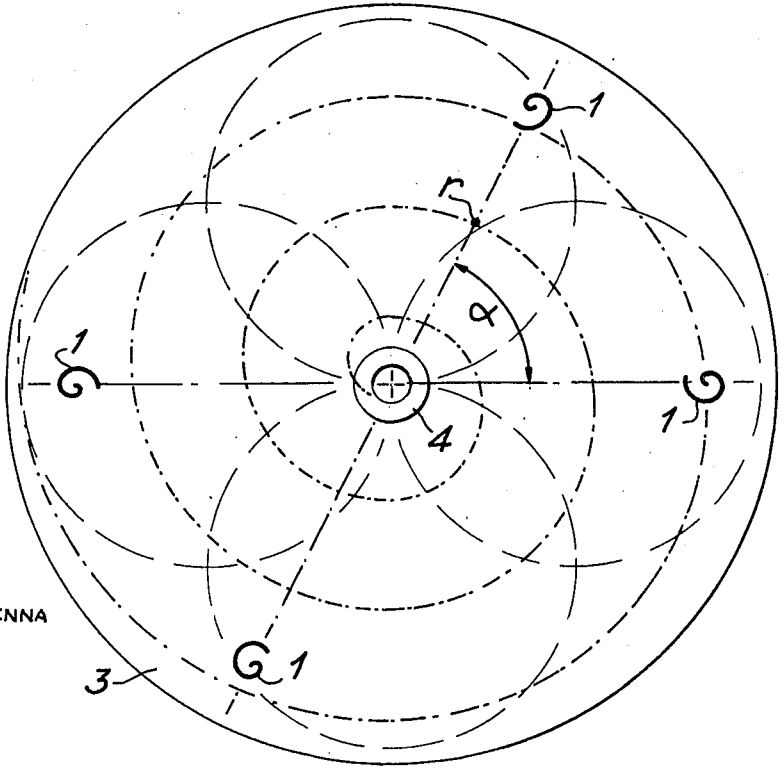
FIGS. 1*a* and 1*b* show respectively in section and in a front view a disk type antenna array.
Figure 1A:
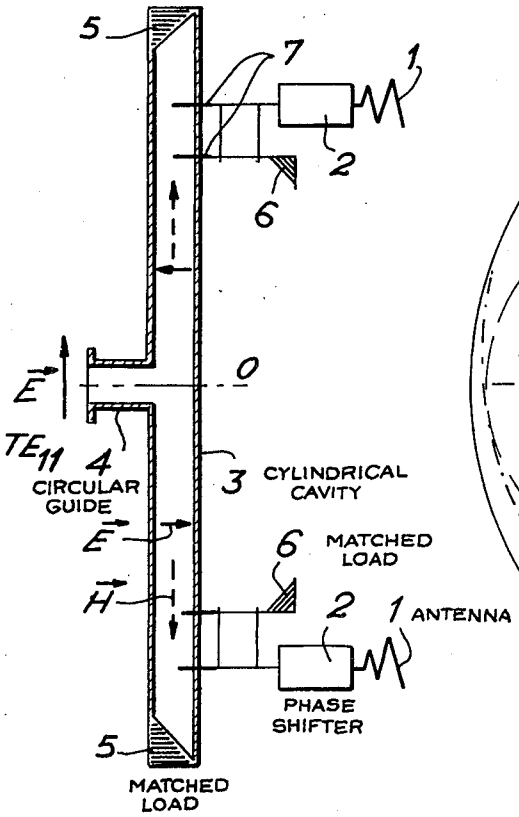

FIG. 1*a* shows the section of a disk-type antenna array. It comprises a cylindrical cavity 3, supplied by means of a circular guide 4. This cavity has on its periphery a matched load 5 formed for example from dielectric materials. Directional probes 7 are connected on the one hand to the matched lobes 6 and on the other hand to the elementary antennae 1 through phase shifters 2. These elementary antennae 1 may for example be of the spiral or helical type. However, other types of elementary antenna elements could be used.

Feeding the antenna in the $TE_{11}$ mode enables the same arrangement as in the prior art of the elementary antennae 1 to be maintained which are then of the spiral or helical type and so present no axial symmetry and are disposed on concentric circles with centre O, O being the point of intersection between the axis of symmetry of the antenna and the radiating surface of the cylindrical cavity 3. This arrangement enables equiphase radiation of the elementary antennae to be obtained if it is accomplished conjointly with an orientation of these elementary antennae 1 made necessary by the use of the $TE_{11}$ mode, such that all the antennae situated on the same circle are deducted from each other by rotation about the axis of symmetry of cylindrical cavity 3. In fact, this radial orientation of the elementary antennae 1 introduces a phase correction of the form $e^{-i\alpha}$ which, added to the modification of phase by phase shifters 2 of the form $e^{ikr}$, leads to an illumination law of the disk-type antenna array of the form $$F(r,\alpha)=f(r,\alpha)\frac{s(r)}{I(r)}e^{-i\alpha}e^{ikr}=s(r)$$

which is a circular symmetry equiphase law radiating a diagram of the same symmetry.

An outstanding advantage of feeding in the $TE_{11}$ mode resides in the possibility of having a second arrangement of the elementary antennae, allowing a less restrictive choice in the type of elementary antennae.

The elementary antennae 1 are then disposed in archimedes spirals, and present an axial symmetry like for example two crossed dipoles. It is then clear that the illumination law for the antenna remains unchanged for being placed on the archimedes spirals, the phase term $e^{i\alpha}$ disappears as well as the term $e^{-i\alpha}$ due to the radial orientation of these elementary antennae 1.

The properties inherent in disk-type antenna arrays are thus preserved while providing a solution for the power loss drawbacks due to the use of the $TM_{01}$ mode for feeding the antenna.

Several types of sensor may be used for feeding the cylindrical cavity 3 of the antenna.

FIG. 2*a* shows one of them which is a T of the fork type whose structure and operation are known. It comprises two rectangular section guides 10 and 11 coupled electromagnetically together. Rectangular section guide 10 is connected to a circular section guide 4. This circular section guide is coupled electromagnetically to a rectangular section guide 12 through a rectangular section guide forming a ring 13. In accordance with the invention this T then receives at transmission two waves on guides 10 and 12. An additional advantage lies then here in the fact that each guide 10 and 12 receives only half the power transmitted. At reception guide 11 gives the difference signal Δ, guide 12 the component of the summing signal $\Sigma_V$ corresponding to vertical polarization, guide 10 the component of the summing signal $\Sigma_H$ corresponding to horizontal polarization.

FIG. 2*b* shows a new structure in accordance with the invention of a fork-type T. It comprises a rectangular section guide 10 connected to a circular section guide 4. A rectangular section guide 11 is coupled electromagnetically to guide 10. The rectangular section guide 11 is such that the plane determined by one of its cross-sections is fixed to a plane delimiting guide 10 and comprising one of the small sides of its cross-section, and such that the large side of a cross-section of guide 11 is orthogonal to the plane delimiting guide 10 and comprising the large side of the rectangular section. A polarizer 20, for example formed from an approximately diamond-shape plate cut out from a dielectric material is fixed in the circular section guide 4 so that the plane of this polarizer 20 forms an angle of $\pi/4$ with respect to the planes delimiting the rectangular section guide 10. An advantage then consists, because of the presence of polarizer 20, in creating a wave with circular polarization in the antenna from a single wave with fixed polarization applied at emission to guide 10, which simplifies proportionately the construction of this fork-type T.

Guide 10, at reception, delivers the summing signal Σ whereas the perpendicular guide 11 delivers the difference signal Δ.

FIG. 2*c* shows a third example of a coupler, called turnstile, which may be advantageous in the case where, with the antenna diagram having to have good characteristics of symmetry, the supply also has these characteristics of symmetry. It comprises besides the circular section guide 4, four rectangular section guides 30, 31, 32 and 33 coupled electromagnetically with the circular section guide 4 so that the large side of the cross-section of guides 30, 31, 32 and 33 is parallel to the axis of the circular section guide 4. Furthermore, each of these rectangular section guides is deducted from the following one by a rotation of $\pi/2$ about the axis of the circular section guide 4. Circular section guide 4 is connected by one end to a coaxial line 34, and a coupling means 35 ensures the electromagnetic connection.

For transmitting, each of the four rectangular section guides 30, 31, 32 and 33 is supplied with a wave in the $TE_{11}$ mode of an amplitude $A_o$ corresponding to a quarter of the total power that the antenna is to receive. If $A_1$, $A_2$, $A_3$ and $A_4$ represent the waves applied respectively to guides 30, 31, 32 and 33, it can be shown that to obtain a wave with circular polarization the following conditions must be fulfilled:

$$A_2 = A_1 e^{i\pi/2}$$

$$A_3 = A_2 e^{i\pi/2}$$

$$A_4 = A_3 e^{i\pi/2}$$

At reception, the components of the summing signal Σ are then obtained on the four wave guides 30, 31, 32 and 33 and the difference signal Δ on the coaxial line 34.

Thus has been described a disk-type antenna array providing a solution to the power problem of the prior art. This antenna is preferably applied to radars carrying out angular deviation measurements.

It is apparent that within the scope of the invention, modifications and different arrangements can be made other than are here disclosed. The present disclosure is merely illustrative with the invention comprehending all variations thereof.

What is claimed is:

1. An antenna comprising:

(a) a cylindrical cavity having first and second faces and a diameter that is larger than its thickness from face-to-face;

(b) a plurality of elementary antennae disposed on the first face; and (c) means coupled to the center of the second face, for coupling a circularly polarized $TE_{11}$ mode wave to the cylindrical cavity, the coupling means including:

(a') a circular waveguide connected to the center of the cylindrical cavity;

(b') a first rectangular waveguide having a first rectangular port and being coupled to the circular waveguide, for coupling a first linearly polarized $TE_{11}$ mode wave to the circular waveguide;

(c') circular polarizing means associated with the circular waveguide for generating from the linearly polarized $TE_{11}$ mode wave, the circularly polarized $TE_{11}$ mode wave; and (d') a second rectangular waveguide having a second rectangular port and being coupled to the first rectangular waveguide, the first and second rectangular waveguides being oriented with respect to one another such that the planes of their respective larger dimensioned sides are perpendicular to one another, the first and second ports delivering on reception, sum and difference components, respectively, of signals received by the antenna.

2. An antenna according to claim 1 wherein the circular polarizing means comprises a plate polarizer made of a dielectric material and being inclined at an angle of $\pi/4$ of radians with respect to the sides of the first rectangular waveguide.

3. An antenna according to claim 2 wherein the plate polarizer is substantially diamond-shaped.

4. An antenna according to claim 1 wherein the circular polarizing means comprises a third rectangular waveguide in the form of a ring, coupled to the circular waveguide through two rectangular slots therein positioned diametrically opposed and perpendicular to the first rectangular waveguide, the third rectangular waveguide having a third rectangular port adapted to receive a second crossed linearly polarized $TE_{11}$ mode wave, the crossed linearly polarized wave combining with the first linearly polarized wave for generating the circularly polarized wave, the third port delivering, on reception, sum components corresponding to its polarization of signals received by the antenna, the first port delivering, on reception, sum components perpendicular to those delivered by the third port.

5. An antenna comprising:

(a) a cylindrical cavity having first and second faces and a diameter that is larger than its thickness from face-to-face;

(b) a plurality of elementary antennae disposed on the first face; and (c) means coupled to the center of the second face, for coupling a circularly polarized $TE_{11}$ mode wave to the cylindrical cavity, the coupling means including:

(a') a circular waveguide having a first end connected to the center of the cylindrical cavity and a second end;

(b') first, second, third and fourth rectangular waveguides, having first, second, third and fourth ports, respectively, coupled to the circular waveguide, the axes of each of the rectangular waveguides being in the same plane and perpendicular to the axis of the circular waveguide, the four ports being spaced at angels of $\pi/2$ radians around the circular waveguide and adapted to receive respective components of a $TE_{11}$ mode wave shifted in phase from one another by $\pi/2$ radians and all having the same amplitude; and (c') a coaxial line coupled to the second end of the circular waveguide, for delivering, on reception, a difference component of a signal received by the antenna.

6. An antenna according to claim 1 or 5 wherein the elementary antennae are disposed along an Archimedes spiral on the first face of the cylindrical cavity.

7. An antenna according to claim 6 further comprising phase shifting circuits coupled to the elementary antennae to obtain electronic scanning.

* * * * *